US006864837B2

(12) United States Patent
Runyon et al.

(10) Patent No.: US 6,864,837 B2
(45) Date of Patent: Mar. 8, 2005

(54) VERTICAL ELECTRICAL DOWNTILT ANTENNA

(75) Inventors: Donald L. Runyon, Duluth, GA (US); James Crawford Carson, Sugar Hill, GA (US); Darin M. Janoschka, Roswell, GA (US)

(73) Assignee: EMS Technologies, INc., Norcross, GA (US)

( * ) Notice: Subject to any disclaimer, the term of this patent is extended or adjusted under 35 U.S.C. 154(b) by 29 days.

(21) Appl. No.: 10/623,379

(22) Filed: Jul. 18, 2003

(65) Prior Publication Data

US 2005/0012665 A1 Jan. 20, 2005

(51) Int. Cl.[7] ..... H01Q 3/26
(52) U.S. Cl. ..... 342/372
(58) Field of Search ..... 342/372, 373, 342/157

(56) References Cited

U.S. PATENT DOCUMENTS

| | | | | |
|---|---|---|---|---|
| 2,913,723 A | | 11/1959 | Thourel | |
| 3,222,677 A | | 12/1965 | Fink | |
| 4,335,388 A | * | 6/1982 | Scott et al. | 342/379 |
| 4,799,065 A | | 1/1989 | Thompson | |
| 5,151,706 A | | 9/1992 | Roederer et al. | |
| 6,188,373 B1 | | 2/2001 | Martek | |
| 6,282,434 B1 | | 8/2001 | Johannisson et al. | |
| 6,292,133 B1 | | 9/2001 | Lynch | |
| 6,337,659 B1 | | 1/2002 | Kim | |
| 6,351,243 B1 | | 2/2002 | Derneryd et al. | |
| 6,441,785 B1 | | 8/2002 | Rosen et al. | |

FOREIGN PATENT DOCUMENTS

| | | |
|---|---|---|
| JP | H9-232865 | 9/1997 |
| JP | P2001-136016 A | 5/2001 |
| WO | WO 01 29926 A1 | 4/2001 |

OTHER PUBLICATIONS

Yamada, Y., Ebine, Y., and Kijima, M—Low Sidelobe Characteristics of a Dual–frequency Base Station Antenna in the Case of Electrical Beam Tilt Use—1999 IEEE Antennas and Propagation International pp 1–4.

Kijima, M., Ebine, Y., Yamada, Y.,—Development of a Dual–Frequency Base Station Antenna for Cellular Mobile Radios—Apr., 1999 IEICE Trans. Comm., vol. E82–B, No. 4, pp 636–644.

Kira, F., Ueno, K., Ohira, T., and Ogawa, H.,—New Design Approach to Multiple–Beam Forming Network for Beam Steerable Phased Array Antenna—Jul. 1999, IEICE Trans Electron, vol. EB2–C, No. 7 pp 1195–1201.

Kira, F., and Hori, T.—Beamforming Network Design for Cluster Feeding of Highly Functional Scanning Antenna—Sep. 2001, IEICE Trans. Commun., vol. E84–B, No. 9, pp 2436–2442.

* cited by examiner

*Primary Examiner*—Bernarr E. Gregory
*Assistant Examiner*—F H Mull
(74) *Attorney, Agent, or Firm*—Michael J. Mehrman; Mehrman Law Office, P.C.

(57) ABSTRACT

A dual-polarization wireless base station antenna that implements vertical electrical downtilt and sidelobe reduction using beam steering circuit that includes a variable power divider and a multi-beam beam forming network. The variable power divider includes a single adjustable control element to divide an input voltage signal into a pair of complimentary amplitude voltage drive signals that exhibit matched phase and constant phase delay through the variable power divider. The beam forming network is configured as a double-sided, edge-connected microstrip module mounted to a main panel, which support the antenna elements in a vertical column organized into sub-arrays in a manner that implements sidelobe reduction. The power distribution network connecting the beam steering network to the antenna elements implements beam tilt bias and sidelobe reduction through coordinated phase shifting implemented through transmission media trace length adjustment.

31 Claims, 10 Drawing Sheets

VERTICAL ELECTRICAL DOWNTILT ANTENNA

REFERENCE TO RELATED APPLICATIONS

This application incorporated by reference the disclosures of commonly owned U.S. patent application Ser. No. 10/290,838 entitled "Variable Power Divider" filed on Nov. 8, 2002; U.S. patent application Ser. No. 10/226,641 entitled "Microstrip Phase Shifted" filed on Aug. 23, 2002; and U.S. patent application Ser. No. 10/623,382 entitled "Double-Sided, Edge-Mounted Stripline Signal Processing Modules And Modular Network" filed on Jul. 18, 2003.

TECHNICAL FIELD

The present invention relates to wireless base station antennas systems and, more particularly, relates to an antenna using a beam steering circuit including a variable power divider and a multi-beam beam forming network to implement vertical electrical downtilt and sidelobe reduction. The antenna, which may be a dual-polarization antenna, may also include a power distribution network that implements beam tilt bias and further sidelobe reduction.

BACKGROUND OF THE INVENTION

The market for wireless base station antennas is highly price and performance competitive. For this reason, it is advantageous to develop antennas having functions that are suitable for use as wireless base station antennas, and that exhibit desirable initial and lifetime cost characteristics. At the same time, it is also desirable to outfit the antennas with a significant range of operational flexibility, so that a standard antenna design may be used for a wide range of potential antenna sites and feature preferences. Meeting these often conflicting design objectives is a continuing challenge for the designers of wireless base station antennas.

In particular, adjustable downtilt and sidelobe minimization are desirable characteristics for a wireless base station antenna. Conventional methods for implementing adjustable downtilt have included mechanical downtilt systems that rely on manual or motorized bracket adjustment. Alternatively, conventional electrical downtilt systems typically rely on multiple beam steering phase shifters. These techniques are relatively expensive to implement. In addition, sidelobe minimization has conventionally been accomplished through relatively complicated antenna element spacing, power distribution, and phase control schemes. These techniques are also relatively expensive to implement.

Accordingly, there is an ongoing need for more cost effective systems for implementing beam tilt and sidelobe minimization for wireless base station antennas.

SUMMARY OF THE INVENTION

The present invention meets the needs described above in an antenna suitable for use as a wireless base station antenna that implements vertical electrical downtilt and sidelobe minimization. The antenna includes a multiple element array and a beam steering circuit including a variable power divider and a multi-beam beam forming network. The antenna also includes a power distribution network connecting the outputs of the beam steering circuit to the individual elements of the antenna array. The variable power divider may employ a single adjustable control element to divide an input voltage signal into a pair of complimentary amplitude voltage drive signals over a range of voltage amplitude division. In addition, the voltage drive signals may exhibit matched phase and constant phase delay through the variable power divider over the range of voltage amplitude division. This configuration produces voltage drive signals for controlling the electrical tilt without the need for multiple phase shifters or mechanical bracket adjustment systems.

The voltage drive signals are used as input signals for the multi-beam beam forming network, which produces a number of beam driving signals that each typically include a beam component associated with each voltage drive signal. Each beam driving signal, in turn, drives a sub-array including one or more antenna elements. As a result, the beam emitted from the antenna is a composite beam that exhibits a directional tilt that varies within a range of tilt in response to changes of the voltage amplitude division within the range of voltage amplitude division. This type of composite beam, which varies in direction in response to changing weighting of multiple component beams, exhibits lower sidelobes than a single-component beam steered though conventional phase control having the same number of adjustable control elements.

The antenna includes an array of antenna elements, which are typically spaced apart in a vertical column and organized into one or more inner sub-arrays located between outer sub-arrays. In addition, the number of antenna elements in the outer sub-arrays may be greater than the number of antenna elements in the inner sub-arrays for the purpose of reducing sidelobe emission. The power distribution network may also be configured to implement coordinated phase shifting of the beam driving signals delivered to the elements of one or more sub-arrays to cause a desired blurring of the phase matching of the signals emitted by antenna elements of the sub-array for the purpose of reducing sidelobe emission.

In addition, the beam forming networks may be implemented as double-sided, edge-connected modules mounted to a main panel, which carries the variable power divider, the power distribution network, and the antenna elements. This configuration produces a number cost and flexibility advantages associated with the modular double-sided, edge-connected construction technique. The various features described above may be included in different combinations and permutations to provide antennas with features and advantages that are suitable for a range of applications and feature preferences.

Generally described, the present invention may be implemented as an antenna system including an array of antenna elements defining a boresight direction. The antenna may include a variable power divider using a single adjustable control element to divide an input voltage signal into a pair of complimentary amplitude voltage drive signals over a range of voltage amplitude division. The voltage drive signals, which may exhibit matched phase and constant phase delay through the variable power divider over the range of voltage amplitude division, feed a beam forming network that produces a number of beam driving signals that typically include a beam component associated with each voltage drive signal. A power distribution network delivers each beam driving signal to one or more associated antenna elements, such that the beam driving signals drive the antenna elements to emit a beam exhibiting a directional tilt with respect to the boresight direction that varies within a range of tilt in response to changes of the voltage amplitude division.

The antenna may also include a number of additional features, such as a field adjustable tilt direction actuator for adjusting the voltage amplitude division and thereby adjusting the directional tilt of the beam. The antenna may also include a power distribution network that implements coordinated phase shifting of the beam driving signals delivered to the antenna elements to cause a desired tilt bias for the range of tilt. The antenna may also include a field adjustable tilt bias actuator for adjusting the tilt bias, and a remote controller for controlling the field adjustable tilt direction actuator and/or the field adjustable tilt bias actuator.

The antenna elements are typically organized into one or more inner sub-arrays located between outer sub-arrays, and each beam driving signal drives an associated antenna sub-array. The number of antenna elements in the outer sub-arrays may be greater than the number of antenna elements in the inner sub-arrays for the purpose of reducing sidelobe emission. In a particular configuration, the number of outer sub-arrays may be two, the number of inner sub-arrays may be two, the number of antenna elements in each outer sub-array may be four, and the number of antenna elements in each inner sub-array may be two. In another particular configuration, the number of outer sub-arrays may be two, the number of inner sub-arrays may be two, the number of antenna elements in each outer sub-array may be five, and the number of antenna elements in each inner sub-array may be three.

In yet another particular configuration, the power distribution network implements coordinated phase shifting of the beam driving signals delivered to the elements of one or more sub-arrays to cause a desired blurring of the phase matching of the signals emitted by the sub-array for the purpose of reducing sidelobe emission. In this alternative, the number of outer sub-arrays may be two, the number of inner sub-arrays may be two, the number of antenna elements in each outer sub-array may be four, and the number of antenna elements in each inner sub-array may be four. Alternatively, the number of antenna elements in each outer sub-array may be three, and the number of antenna elements in each inner sub-array may be three.

The beam forming network is typically implemented as a two-by-four orthogonal beam forming network or as a four-by-four Butler matrix. In addition, each antenna element may be a dual-polarization antenna element, and the antenna system may include a similar variable power divider, beam forming network, and power distribution network for each polarization. In this case, the field adjustable tilt direction actuators may be mechanically linked to each other to adjust the beam tilt for both polarities in a coordinated manner. In addition, the power distribution network may implement coordinated phase shifting of the beam driving signals delivered to the sub-arrays to cause a desired tilt bias of the range of tilt for each polarization. In this case, the antenna system may also include a field adjustable tilt bias actuator for adjusting the tilt bias for both polarizations in a coordinated manner.

The antenna typically includes a substantially flat panel defining a longitudinal axis substantially perpendicular to the boresight direction. In addition, the panel supports the array of antenna elements in a spacing configuration having a substantially vertical distribution, and the array is divided into one or more inner sub-arrays located vertically between outer sub-arrays. The beam forming network may also be configured as a double-sided, edge-connected module mounted to the main panel.

The preceding design components may combined to create a number of different of vertical electrical downtilt antennas with different features suitable for a range of wireless base station applications and feature preferences. It should be understood that the features described above may be implemented in different combinations and permutations suitable for particular applications. That is, the present invention contemplates providing a number of antenna features that may be mixed and matched on as as-needed basis to provide cost effective alternatives for a wide range of applications and feature preferences. Therefore, the invention is not limited to any particular combination of features.

In view of the foregoing, it will be appreciated that the present invention avoids the drawbacks of prior methods for implementing antenna downtilt and sidelobe reduction. The specific techniques and structures for implementing antenna downtilt and sidelobe reduction, and thereby accomplishing the advantages described above, will become apparent from the following detailed description of the embodiments and the appended drawings and claims.

DETAILED DESCRIPTION OF THE EMBODIMENTS

The present invention may be embodied in a number of antenna features for implementing vertical electrical downtilt and sidelobe reduction for wireless base station antenna systems. Although these antenna systems are specifically designed for deployment as wireless base station antennas, the various features of the invention may be used in other applications, such as satellite communication systems, military radar, military communication systems, and any other beam steering application. However, these applications may exhibit different cost and performance considerations that may militate in favor of different, and potentially more sophisticated, beam steering and sidelobe reduction approaches. In addition, many additional antenna features may be implemented in connection with the antenna features described below. However, each of these modifications might add cost and complexity to the system. Therefore, it should also be appreciated that the preferred embodiments described below are presently believed to embody the most technically and economically feasible vertical electrical downtilt antennas for many wireless base station applications.

In particular, the specific antenna embodiments descried below are dual-polarization panel antennas having a single vertical column of antenna elements. For this configuration, the beam tilting equipment effects variable beam downtilt with a downward tilt bias, which is desirable for most wireless base station applications. However, the tilt orientation could be readily modified to azimuth or any other desired tilt plane. In addition, the antenna elements need not be dual-polarization, and need not be organized into a single vertical column. For example, the antenna element spacing configuration could include multiple vertical columns, one or more rows, or any other spacing desired alternative. Again, however, a panel antenna having a single vertical column of dual-polarization antenna elements is presently considered to be the most technically and economically feasible alternative for vertical electrical downtilt antennas for wireless base station applications.

The specific antenna embodiments descried below also include advantageous design features implemented within the variable power divider, the beam forming network, and the power distribution network. These design features may be provided in various combinations and permutations to suit particular applications and feature preferences. Therefore, the invention should not be limited to any particular combination of features except as stated in the claims.

Figure 1:
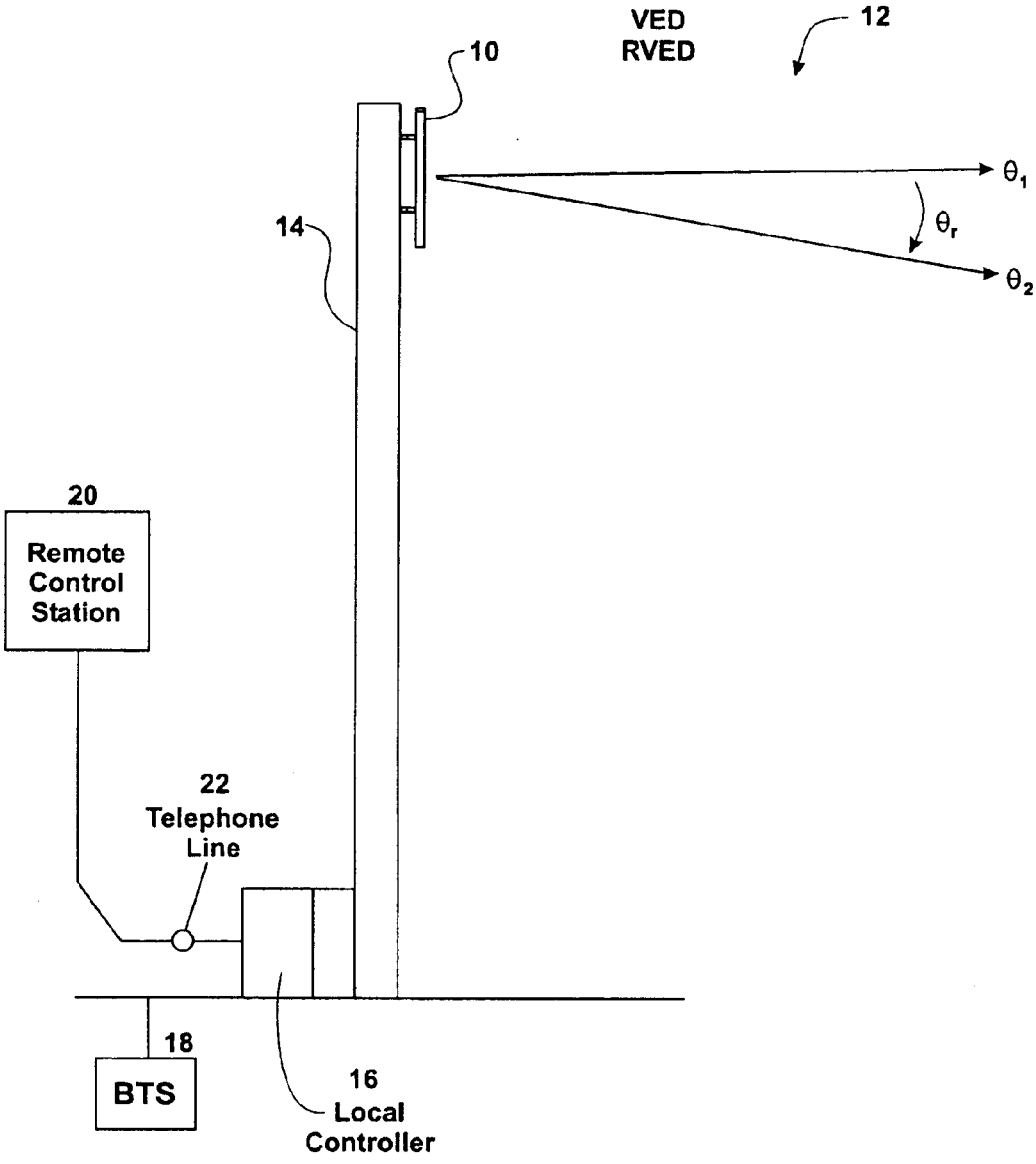
FIG. 1 is a block diagram of a remotely controlled vertical electrical downtilt antenna deployed as a wireless base station antenna.

Turning now to the figures, in which like numerals refer to similar elements throughout the several figures, FIG. 1 is a block diagram of a remotely controlled vertical electrical downtilt antenna 10 deployed as a wireless base station antenna. This antenna is equipped to perform vertical electrical downtilt of a beam 12 emitted by the antenna. More specifically, the antenna 10, which is typically mounted to a pole 14, tower, building or other suitable support structure, includes an upright panel that supports a number of antenna elements. These antenna elements emit the beam 12 in a boresight direction 15 (shown in FIG. 2), which is the natural propagation direction of the beam when the signals emitted by the antenna elements are in phase. In the particular example shown in FIGS. 1 and 2, the antenna 10 is mounted with its main panel oriented vertically, which generally results in a horizontal boresight direction. This is a typical mounting configuration for a wireless base station antenna.

From the horizontal boresight direction 15, some mechanism is typically provided to direct the beam 12 downward toward the horizon. It is also desirable to have adjustable beam downtilt so that the beam can be pointed toward a desired geographical coverage area where the beam will be received with appropriate strength and to discriminate against the transmission of signals to areas generally beyond the geographical coverage area. The antenna 10 is reciprocal and the properties of the antenna in a reception mode of operation are the same as for a transmission mode at each frequency in the operational band of frequencies. The antenna 10 is configured to implement adjustable beam downtilt within a range $\Theta_r$ that extends between two boundary beam pointing directions, $\Theta_1$ and $\Theta_2$. The tilt range range $\Theta_r$ is also typically biased downward from the boresight direction. For example, the upper tilt boundary is typically set toward or just below horizontal, and the tilt range $\Theta_r$ typically extends to about five degrees downward. For example, tilt ranges from one to five degrees from horizontal, and from two to seven degrees from horizontal are typical for antenna arrays having twelve or more radiating elements. However, the selection of the tilt bias and tilt range is a design choice that may be changed from application to application.

Figure 2:
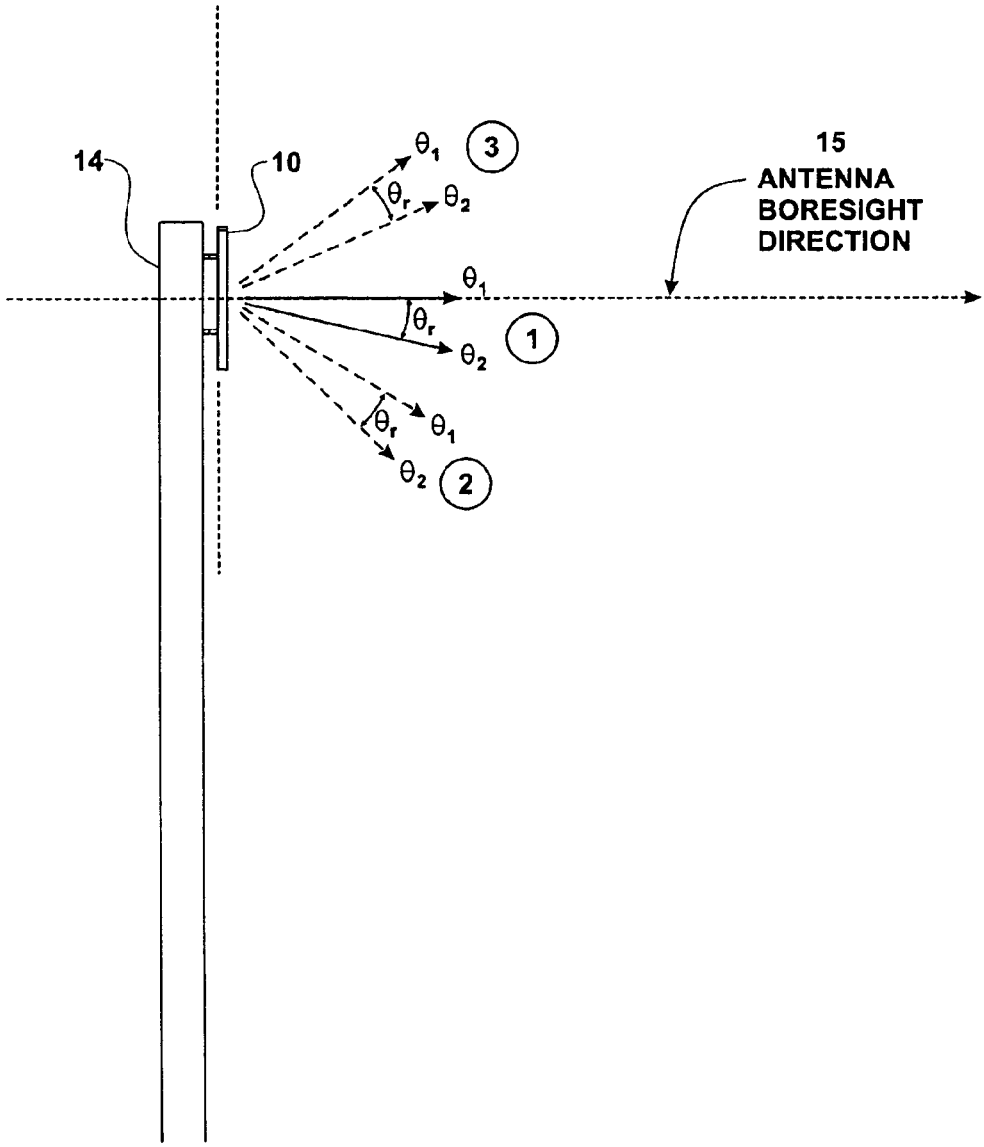
FIG. 2 is a diagram illustrating a vertical electrical downtilt antenna with an adjustable tilt bias.

In addition, the tilt bias may be fixed or adjustable. FIG. 2 illustrates the adjustable tilt bias alternative by showing three tilt bias angles for the antenna 10. For an antenna with an adjustable tilt bias, this parameter may altered manually or mechanically, and it may be controlled locally or remotely.

Referring again to FIG. 1, the beam tilt bias and the tilt angle within the adjustable tilt range may be controlled is several different ways. For example, one or more control knobs may be located on the antenna 10 itself, typically on the rear of the main panel. However, climbing the pole 14 to adjust the beam tilt may be inconvenient. Therefore, a local controller 16 may be located at a suitable location, such as the base of the pole or with the base transceiver station 18 (BTS). In this case, a motor, such as a servo or stepper motor, drives the tilt control in accordance with control signals from the local controller 16. The motor is typically mounted to the rear of the main panel of the antenna 10, but could be located in any other suitable location. In addition, a remote controller 20 may be used to remotely control the beam tilt. For example, the remote controller 20 is typically connected to the local controller 16 by way of a telephone line 22 or other suitable communication system. The local and remote controllers may be any suitable control device, as are well known in the art.

Figure 3:
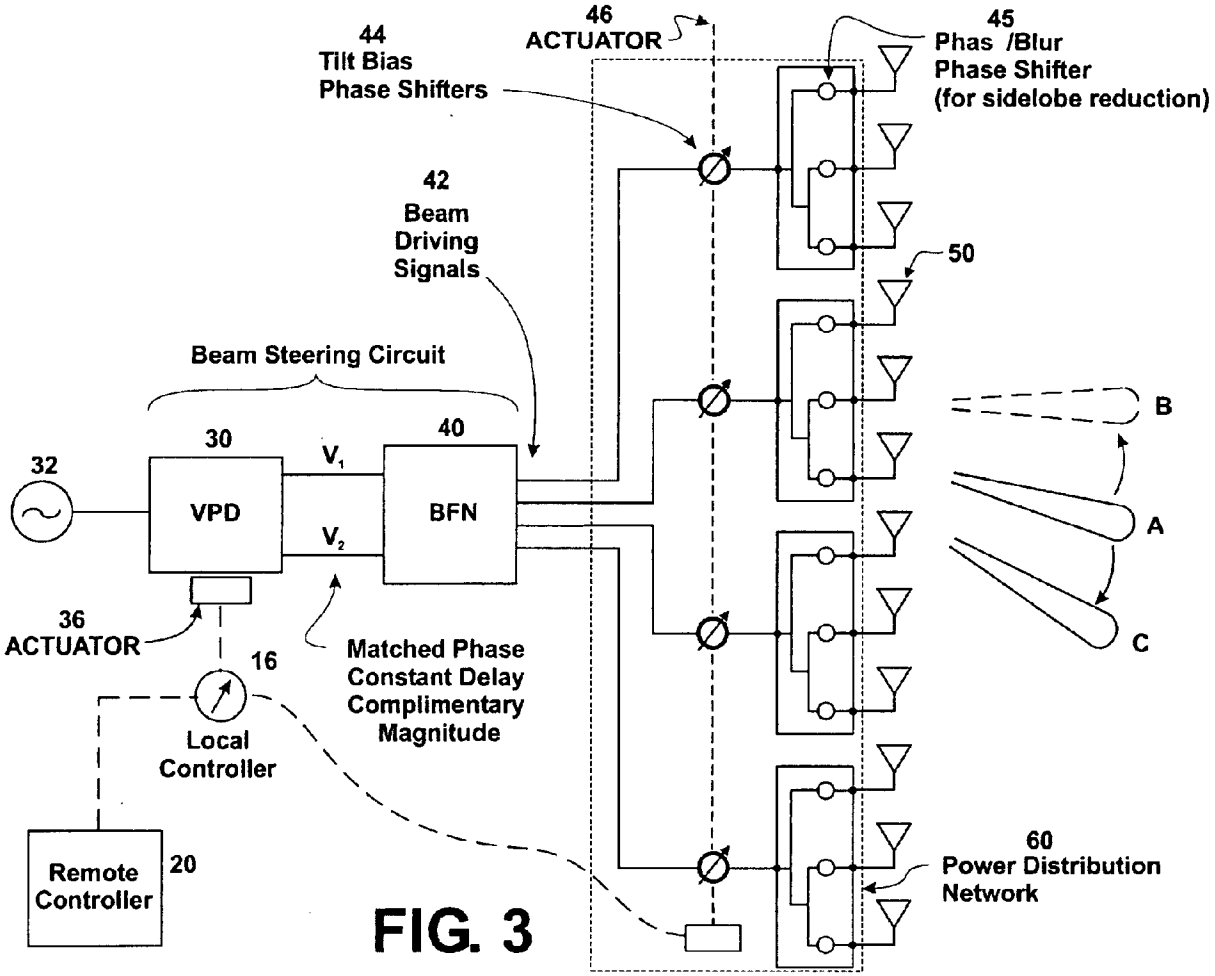
FIG. 3 is a functional block diagram of a vertical electrical downtilt antenna.

FIG. 3 is a functional block diagram of the antenna 10, which includes a beam steering circuit that includes a variable power divider 30 and a multi-beam beam forming network 40. The variable power divider 30 divides a voltage signal 32 into two complimentary amplitude voltage drive signals, which provide inputs to the multi-beam beam forming network 40 (BFN). The beam forming network 40, in turn, produces beam driving signals 42 that are transmitted by a power distribution network 60 to a multi-element antenna array 50. The power distribution network 60 divides each beam driving signals as appropriate for delivery to an associated sub-array of the multi-element antenna array 50. The power distribution network 60 also includes tilt bias phase shifters 44 and phase blurring phase shifters 45, which manipulate the phase characteristics of the beam steering signals in a coordinated manner through transmission media trace length adjustment to implement beam tilt and sidelobe reduction.

Figure 4:
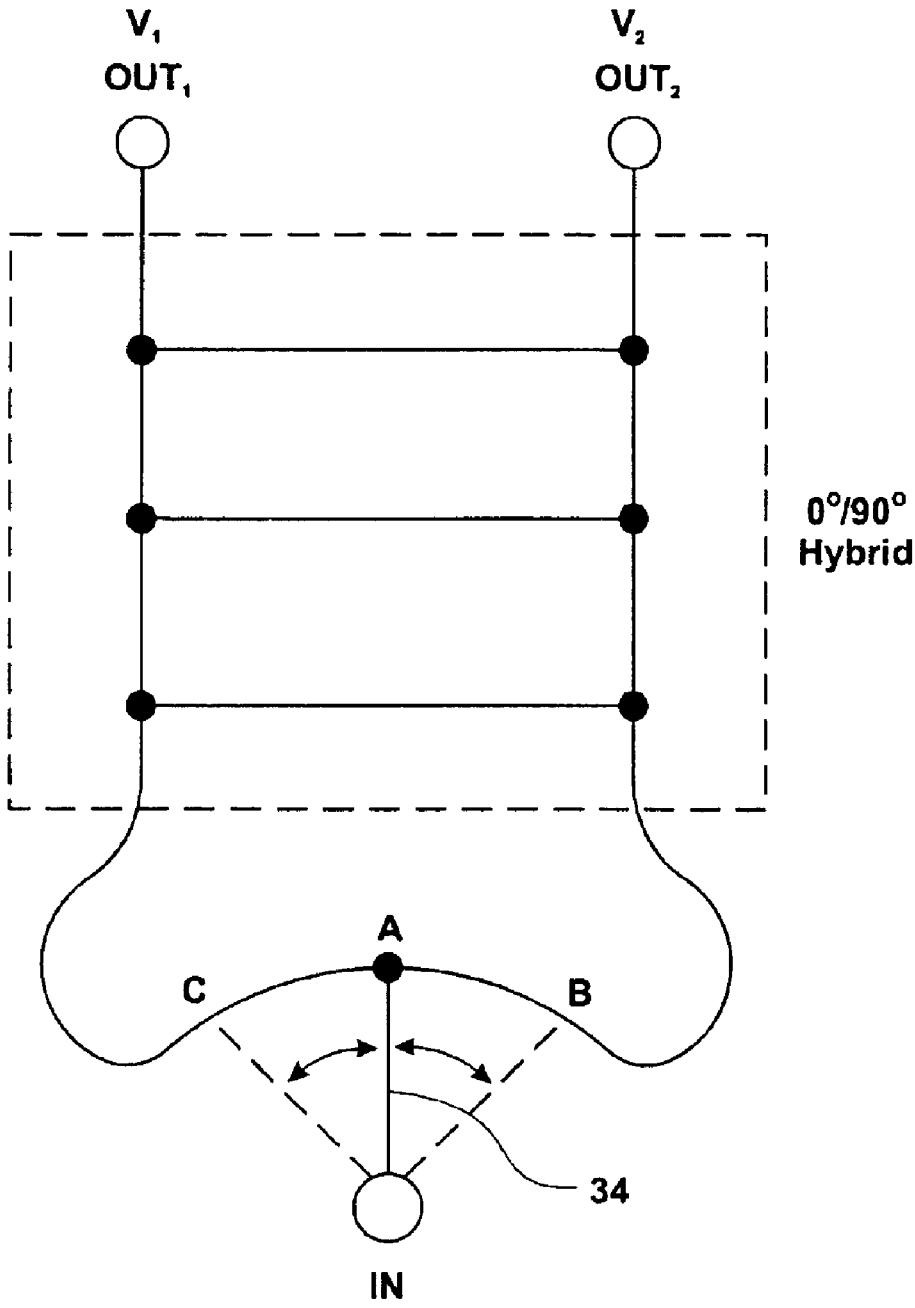
FIG. 4 is a conceptual illustration of a variable power divider for use in the variable electrical downtilt antenna.
Figure 5A:
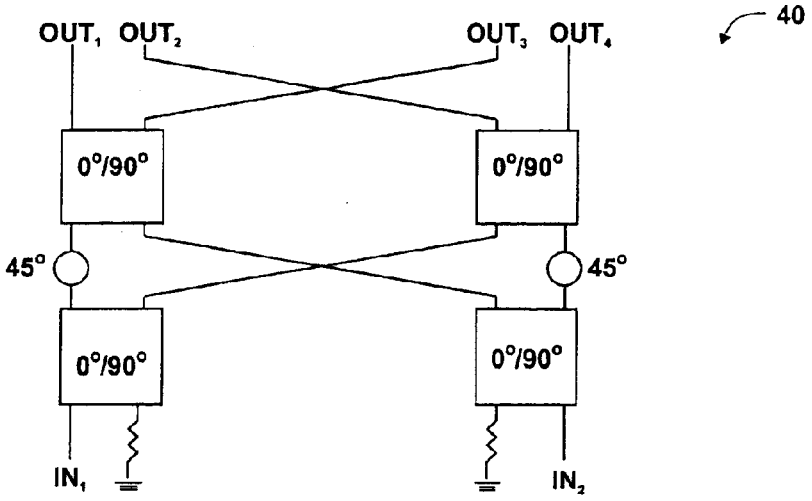
FIG. 5A is an electrical schematic diagram of a beam forming network for use in the variable electrical downtilt antenna.
Figure 5B:
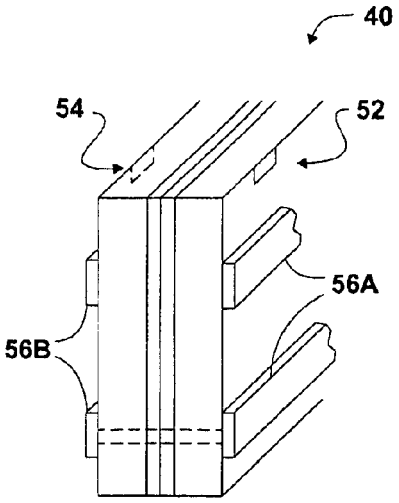
FIG. 5B is a perspective end view of a double-sided, edge mounted module design for the beam forming network.
Figure 5C:
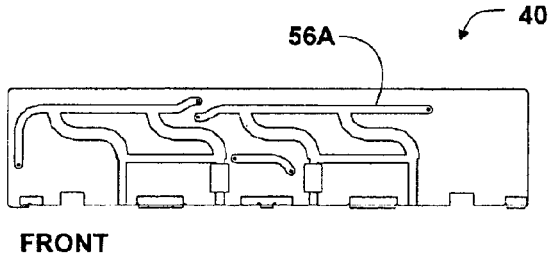
FIG. 5C is a side view of a first transmission media circuit of the double-sided, edge mounted beam forming network module.
Figure 5D:
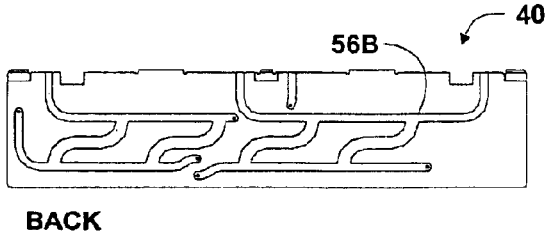
FIG. 5D is a side view of a second transmission media circuit of the double-sided, edge mounted beam forming network module.

The variable power divider 30 receives and divides a voltage signal 32 into two voltage drive signals $V_1$ and $V_2$. The voltage signal 32 typically contains encoded mobile communications data and is provided through a coaxial cable that attaches to a connector on the antenna 10, as is well known in the art. FIG. 4 is a conceptual illustration of the variable power divider 30, which is described in greater detail in commonly owned U.S. patent application Ser. No. 10/290,838 entitled "Variable Power Divider" filed on Nov. 8, 2002, which is incorporated herein by reference. The variable power divider 30 uses a single adjustable control element 34, typically a microstrip wiper arm, to divide the input voltage signal 32 into the voltage drive signals $V_1$ and $V_2$, which have complimentary amplitude over the range of voltage amplitude division.

More specifically, the amplitudes of sum of $V_1$ and $V_2$ sum to the amplitude input voltage signal 32, and vary inversely with each other as the power is divided between them. In particular, the power division ranges from 100% to $V_1$ and zero to $V_2$ when the adjustable control element 34 is in the position labeled "B" on FIG. 4 to zero to $V_1$ and 100% to $V_2$ when the adjustable control element 34 is in the position labeled "C" on FIG. 4. In addition, the power division varies smoothly between these two extremes as the adjustable control element 34 is moved between the positions "B" and "C" with position "A" representing the 50% division point.

In addition to having complimentary amplitude, the voltage drive signals $V_1$ and $V_2$ exhibit matched phase (i.e., they continuously have substantially the same phase) and substantially constant phase delay through the variable power divider 30. In other words, the phase characteristics of the voltage drive signals $V_1$ and $V_2$ with respect to each other, and with respect to the input voltage signal 32, remains substantially constant as the power division varies through the range of power division. An actuator 36, such as a control knob or motor, is used to move the adjustable control element 34, which in turn causes adjustment of the beam tilt. This is illustrated in FIGS. 3 and 4, in which the beam tilt position labeled "A" in FIG. 3 corresponds to the position "A" of the adjustable control element 34 shown in FIG. 4; the beam tilt position labeled "B" in FIG. 3 corresponds to the position "B" of the adjustable control element 34 shown in FIG. 4; and the beam tilt position labeled "C" in FIG. 3 corresponds to the position "C" of the adjustable control element 34 shown in FIG. 4.

Referring again to FIG. 3, the voltage drive signals $V_1$ and $V_2$ provide input signals to the multi-beam beam forming network 40, which is typically configured as an orthogonal two-by-four beam forming network or a four-by-four Butler matrix with two of the input ports shunted to ground through impedance matching resistors. FIGS. 5A–D Illustrates the later configuration. Both configurations, along with a number of other signal processing modules, are described in detail in commonly owned U.S. patent application Ser. No. 10/623,382 entitled "Double-Sided, Edge-Mounted Stripline Signal Processing Modules And Modular Network" filed on Jul. 18, 2003, which is incorporated herein by reference. Although the beam forming network 40 need not be configured as a double-sided, edge-mounted module, this configuration results in may advantages.

It should be appreciated that the number of outputs of the beam forming network 40 typically corresponds to the number of antenna sub-arrays, and may therefore be altered in accordance with the needs of a particular application. Although antennas with four and eight sub-arrays are common, other configurations, such as three, five and six sub-arrays are also typical. Of course, any desired number of sub-arrays and a wide variety of beam forming networks may be accommodated.

It is presently believed that a seven-layer modular PC board construction works best for the beam forming network modules 40. This configuration includes a multi-layer, double-sided stripline module having a first outer ground plane layer, followed by a dielectric layer, followed by a first stripline circuit layer, followed by a dielectric layer, followed by a center ground plane layer, followed by a dielectric layer, followed by a second stripline circuit layer, followed by a dielectric layer, followed by a second outer ground plane layer. That is, the preferred board configuration includes the structure illustrated in FIGS. 5B with additional dielectric covers carrying outer ground planes adhered to the outer sides 52 and 54 of the module 40. Adding dielectric covers carrying outer ground plane layers reduces radiation loss and interference in the stripline transmission media circuits 56A–B.

The beam forming network 40 of this particular antenna 10 outputs four beam driving signals 42 that each include a component from each of the voltage drive signals $V_1$ and $V_2$. Each beam driving signal, in turn, feeds one sub-array of the antenna array 50. The power distribution network 60 connects the output ports of the beam forming network 40 to the antenna elements of the antenna array 50.

Figure 6A:
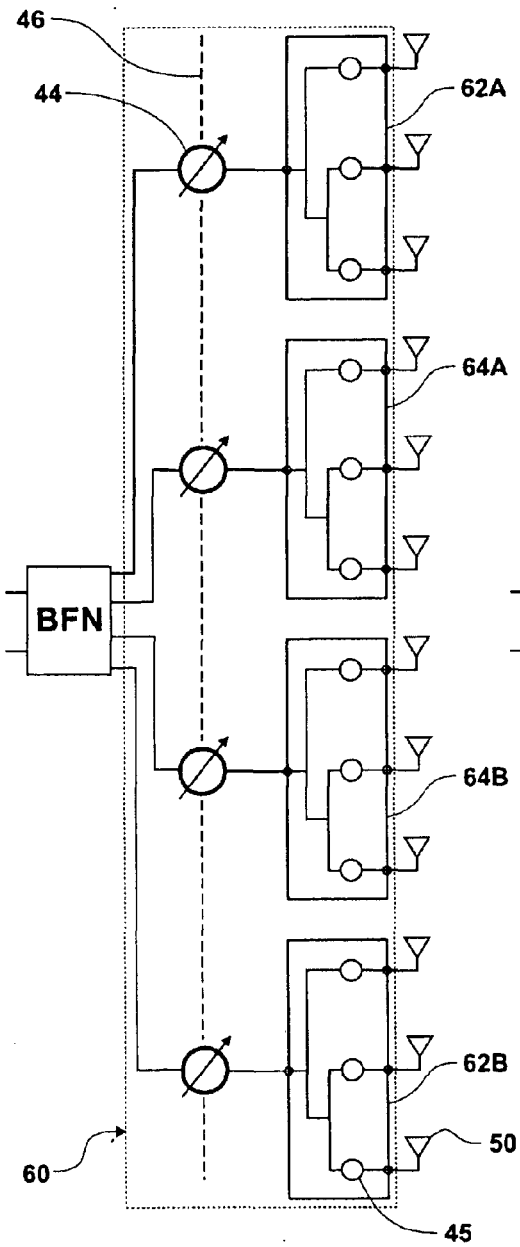
FIG. 6A is a conceptual illustration of a power distribution network for a twelve element antenna array.
Figure 6B:
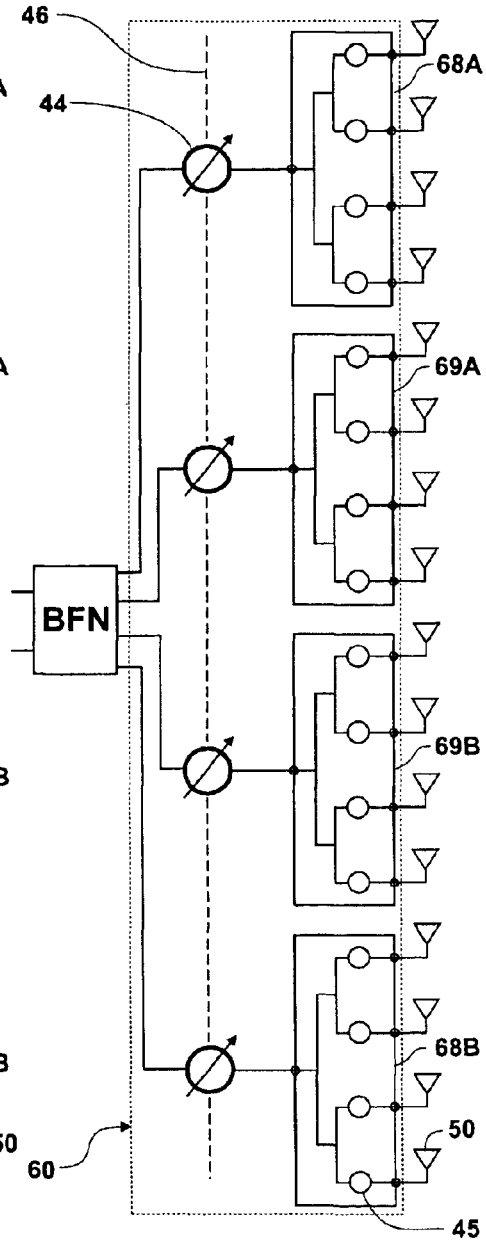
FIG. 6B is a conceptual illustration of a power distribution network for a sixteen element antenna array.
Figure 7A:
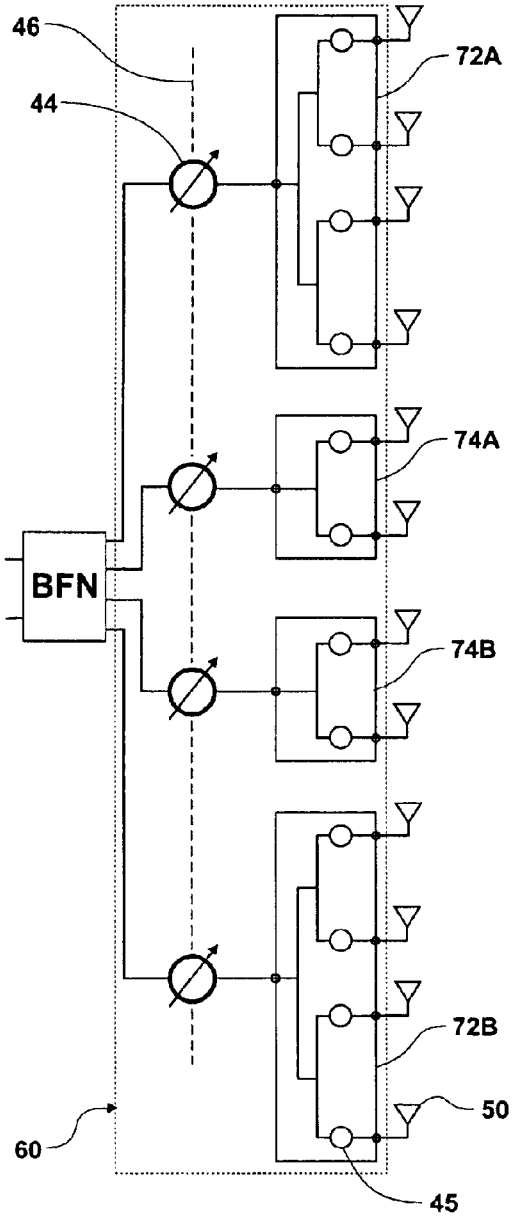
FIG. 7A is a conceptual illustration of a power distribution network for a twelve element antenna array including outer sub-arrays having more antenna elements then inner sub-arrays.
Figure 7B:
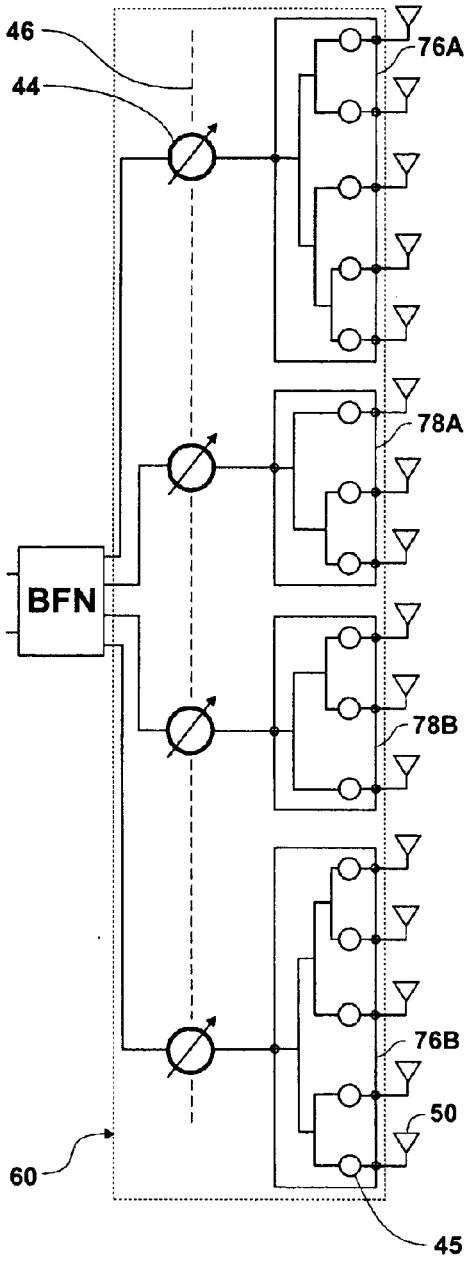
FIG. 7B is a conceptual illustration of a power distribution network for a sixteen element antenna array including outer sub-arrays having more antenna elements then inner sub-arrays.
Figure 8:
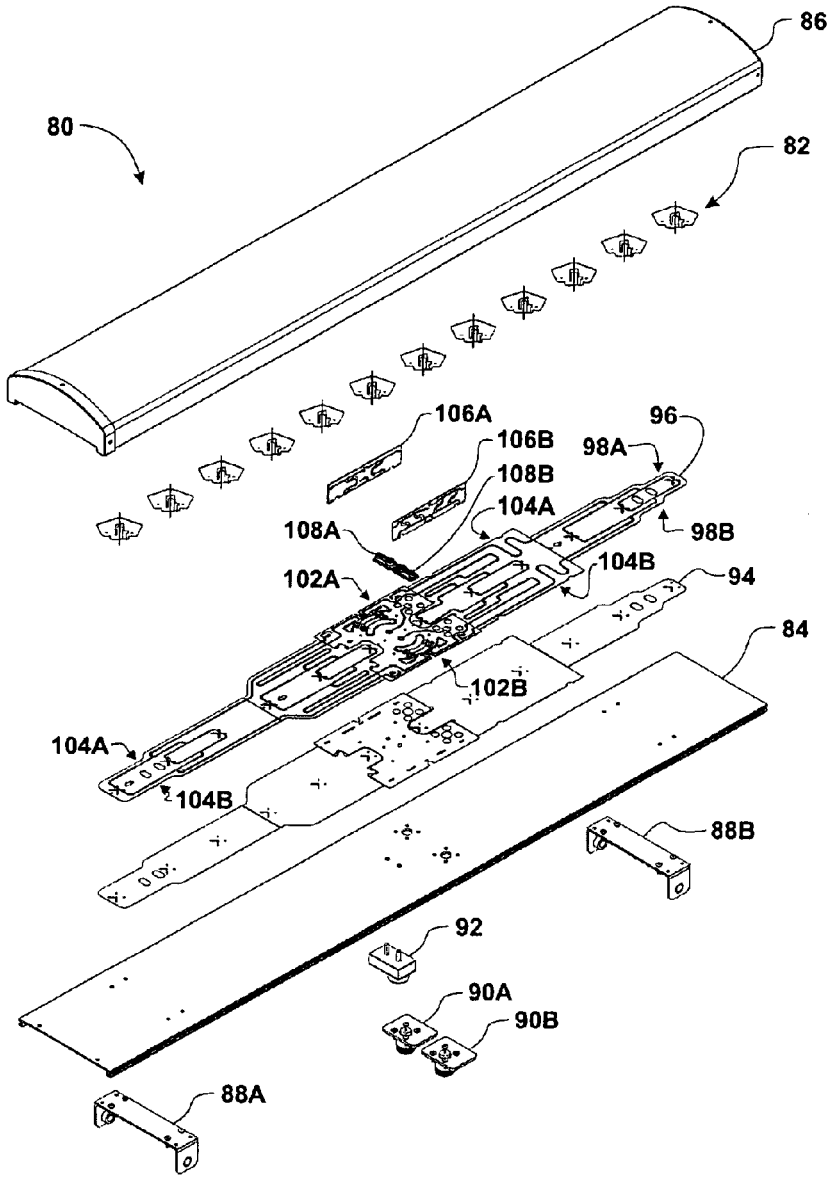
FIG. 8 is a perspective exploded view of a vertical electrical downtilt antenna.

The antenna array 50 includes a vertical column of dual-polarization antenna elements, as shown in FIG. 8. The vertical column is typically divided into sub-arrays as shown in FIGS. 6A–8 and 7A–B. The use of sub-arrays is typical for a wireless base station antenna configured to implement vertical electrical downtilt due to the range of variable beam tilt generally needed. It should be appreciated that the techniques described above may be used to control beam tilt in any desired direction, and that the antenna array 50 may be of any desired configuration, such as a row, multiple rows, multiple columns, a three-dimensional special arrangement, or any other desired multi-element configuration. It should also be appreciated, however, that a single column of a relatively small number of antennal elements, such as twelve or sixteen, divided into a relatively small number of sub-arrays, such as four, results in a cost effective antenna with sufficient vertical electrical downtilt and sidelobe reduction for many wireless base station applications.

The power distribution network 60 is typically configured as microstrip transmission media segments etched onto a dielectric PC board substrate. The beam forming network 40 drives two component beams "B" and "C" which vary in power with the voltage power division. That is, the component beam "B" corresponds to the voltage drive signal $V_1$ and the component beam "C" corresponds to the voltage drive signal $V_2$. Therefore, beam "B" is emitted when the voltage drive signal $V_1$ receives 100% of the power (i.e., corresponding to wiper arm position "B" shown on FIG. 4), and beam "C" is emitted when the voltage drive signal $V_2$ receives 100% of the power (i.e., corresponding to wiper arm position "C" shown on FIG. 4). When the power is split between the voltage drive signals $V_1$ and $V_2$, the component beams combine to produce a composite beam located between the component beams, as represented by beam "A." The pointing direction of the composite beam "A" thus varies between directions "B" and "C" with the power division between the voltage drive signals $V_1$ and $V_2$. Tilting a composite beam in the manner described above advantageously produces lower sidelobes than a single-component beam steered through conventional phase control using the same number of control devices. The sidelobes of the component beams partially cancel each other as they combine to form the composite beam. Driving different and variable signals to, for example, four sub-arrays typically is accomplished using three control devices (i.e., a number being one less than the number of sub-arrays) when conventional phase shifting approaches are used. Hence, the method defined herein advantageously reduces the number of control devices needed to drive different and variable signals to sub-arrays of an array antenna for he purpose of downtilting a beam.

In view of the preceding, it should be understood that increasing the number of antenna sub-arrays and increasing the spacing between the antenna elements and/or the sub-arrays are generally effective at producing further sidelobe reduction. However, the cost associated with these design changes must be weighed against the additional benefit to be obtained. It should also be appreciated that providing a relatively small antenna array emitting a composite beam, as taught in this specification, is generally a more cost effective method of implementing side lobe reduction than conventional methods applied to single-component beams, such as increasing the antenna element spacing and deploying multiple columns of antenna elements, which results in a larger antenna array. It should also be appreciated that providing a range of downtilt that spans an extent that is approximately equal to one half-power beam width of the antenna using one control device is advantageous in simplicity and cost.

Still referring to FIG. 3, the lengths of the microstrip transmission media trace segments of the power distribution network 60 connecting the outputs of the beam forming network 40 with the antenna elements 50 are nominally selected to cause the signals to be in phase when they reach the antenna elements, which produces a beam pointed in the boresight direction of antenna. To offset the beam direction from the boresight direction, tilt bias phase shifters 44 are included in the transmission media traces for the beam drive signals 42. Fixed phase tilt bias phase shifters can be implemented through trace length adjustments to implement a desired fixed beam tilt bias. Additionally or alternatively, variable phase shifters may be use to provide a variable tilt bias, as illustrated in FIG. 2.

A common actuator 46 may be used to drive the adjustable tilt bias phase shifters 44 in a coordinated manner. For example, a toothed rack may drive common pinion gears that, in turn, drive similar extension arms of trombone-type or wiper-type microstrip or other suitable phase shifters. The actuator may be manual, such as a knob, or motorized, and may be controlled locally or remotely, as shown on FIG. 1.

In addition, one or more of the sub-arrays may include one or more antenna element phase shifters 45 to slightly alter the phase signal delivered to the elements of the sub-array. That is, an individual phase shifter is typically located within the transmission media trace feeding an associated antenna element. These phase shifters are designed to slightly mismatch or "blur" the phase matching of the signals emitted by antenna elements of the associated sub-arrays for the purpose of reducing sidelobe emission. In particular, the phase matching of the signals emitted by outer sub-arrays may be blurred a bit more severely than the signals emitted by the inner sub-arrays for the purpose of further reducing sidelobe emission.

The antenna element phase shifters 45 are typically implemented through transmission segment length adjustment. However, other types of phase shifters may be used. In particular, phase shifters implemented through transmission segment length adjustment impose fixed phase shifts. Alternatively, adjustable antenna element phase shifters may be used, which may be locally or remotely controlled. However, cost considerations may favor implementing the antenna element phase shifters 45 through fixed length transmission segment adjustments. FIG. 6A is a conceptual illustration of the power distribution network 60 feeding the antenna array 50. This particular embodiment includes a vertical column of twelve antenna elements organized into two outer sub-arrays 62A–B and two inner sub-arrays 62A–B that each include three antenna elements. Each sub-array is fed by an associated one of the beam driving signals 42. The antenna includes adjustable tilt bias phase shifters 44 and fixed phase blur phase shifters 45, as described previously with reference to FIG. 3. FIG. 6B is a conceptual illustration of a similar sixteen element antenna array design including two outer sub-arrays 68A–B and two inner sub-arrays 69A–B that each include four antenna radiating elements. The twelve and sixteen element designs shown in FIGS. 6A–B are believed to be suitable for use as wireless base station antennas.

FIG. 7A is an alternative design for a twelve element antenna array including two outer sub-arrays 72A–B that each include four antenna elements, and two inner sub-arrays 74A–B that each include three antenna elements. Having outer sub-arrays with more antenna elements than the inner sub-arrays reduced the relative power delivery to the individual elements of the outer sub-arrays 72A–B. This has the effect of reducing the sidelobe emission of the antenna. FIG. 7B is a similar alternative antenna design for a sixteen element antenna array including two outer sub-arrays 76A–B that each include five antenna elements, and two inner sub-arrays 78A–B that each include three antenna elements. Again, the twelve and sixteen element designs shown in FIGS. 7A–B are believed to be suitable for use as wireless base station antennas.

FIGS. 8–11 are computer-aided design (CAD) to-scale illustrations of a particular commercial embodiment of the vertical electrical downtilt antenna 80 shown in FIG. 6A, which includes twelve dual-polarization antenna elements 82. This antenna is designed for an operational carrier frequency of 1.92 GHz (which is the center frequency of the authorized US Personal Communication Services, PCS, wireless band), and the antenna elements are spaced 0.7 free-space wavelength apart, which is approximately 4.6 inches. The electrically conducting backplane 84 for this antenna is rectangular with dimensions 56 inches long by 8 inch wide [approximately 142 cm by 20 cm]. A sixteen element antenna is correspondingly longer, 72 inches long by 8 inches wide [approximately 183 cm by 20 cm] to accommodate four additional antenna elements with the same spacing. The radome 86 fits over and attaches to the backplane.

The antenna 80 includes two mounting brackets 88A–B, two coaxial cable antenna interface connectors 90A–B, and an actuator knob assembly 92 that connect to the rear side of the backplane 84. The coaxial cable connectors 90A–B receive coaxial cables supplying two input voltage signals 32 (shown on FIG. 3), one for each polarization of the dual-polarization antenna. A conducting ground planeon the underside of a main panel dielectric 96 is attached with a non-conducting adhesive 94 to the front side of the backplane 84. The conducting ground plane of the main panel printed circuit (PC) board 96 is capacitively coupled to the backplane 84 for RF signal flow across the junction. The main panel 96 is a dielectric PC board etched with tin-coated copper traces that form transmission media segments carrying the voltage signals from the coaxial cables connectors 90A–B to the antenna elements 82. More specifically, the transmission media segments form two virtually identical beam steering and power distribution circuits 98A–B, one for each polarization.

The dielectric material of the main panel 96 may be PTFE Teflon®, a laminate impregnated with glass fibers, having a dielectric constant equal to 2.2 ($\epsilon_r$=2.2). This material can be used to construct PC boards that will exhibit an effective dielectric constant of 1.85 ($\epsilon_{reff}$=1.85) for microstrip transmission media segments exposed to the PC board on one side and exposed to air on the other side. For this type of PC board circuit, the wavelength in the guide ($\lambda_g$) (i.e., the wavelength as propagating in the microstrip transmission media as laid out on the PC board with one side exposed to the dielectric substrate and the other side exposed to air) is approximately 4.52 inches [11.48 cm]. Referring to FIGS. 3 and 4 as well as FIG. 8, two variable power dividers 102A–B (one for each polarization—element 30 on FIG. 3) and two power distribution networks 104A–B (one for each polarization—element 60 on FIG. 3) are located on the main panel 96, whereas two beam forming networks 106A–B (one for each polarization—element 40 on FIG. 3) are implemented as double-sided, edge-mounted modules that are solder-connected to the main panel 96. Two wiper arms 108A–B (one for each polarization—element 34 on FIG. 4) are pivotally attached to the variable power divider areas of the main panel 96. The wiper arms 104A–B are formed on small dielectric PC boards with etched copper traces similar to the materials used to construct main panel (but without a ground plane), and are mechanically coupled to each other through dove-tail gears formed into rear portions of the wiper arms. This allows both wiper arms to be moved in a coordinated manner by the single actuator knob 92 (element 36 on FIG. 3). In motorized embodiments, the actuator knob assembly 92 is replaced by a small motor and mechanical drive, such as a servo or stepper motor, mounted to rear of the backplane 84. The motor may be housed in a suitable enclosure and attended typically with an electronics PC board assembly associated with electrical power and motor control.

In addition, for embodiments including variable tilt bias, a rack and pinion drive system with a separate motor is typically attached to the rear side of the backplane 84. As noted previously, the tilt bias phase shifters may be implemented as gear-driven, trombone-type or wiper-type phase shifters, which are distributed in two rows (one for each polarization) along the main panel 96. In addition, a single toothed rack moved by a single knob or motor driven gear can typically be used to turn all of the tilt bias phase shifters in a coordinated manner so that all of the antenna elements for both polarizations are tilt biased in a coordinated manner.

Figure 9:
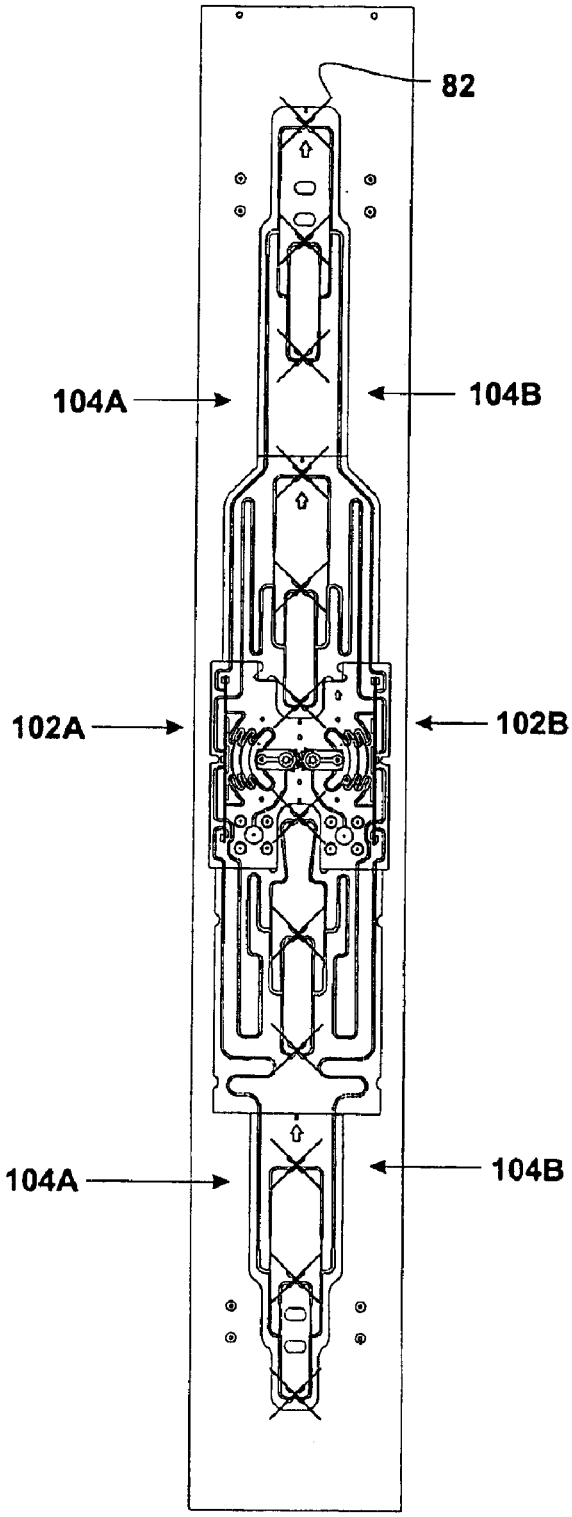
FIG. 9 is a front view of a main panel for a vertical electrical downtilt antenna.

FIG. 9 is a front view of the main panel 96. One of the antenna elements 82 is labeled for reference. The variable power dividers 102A–B and the power distribution networks 104A–B are shown a bit more clearly in this view. The wiper arms 108A–B are shown in the center of the main panel 96 but have not been labeled to avoid obscuring the figure. The beam forming modules 106A–B are difficult to see in this view because they are edge mounted to the main panel 96.

Figure 10:
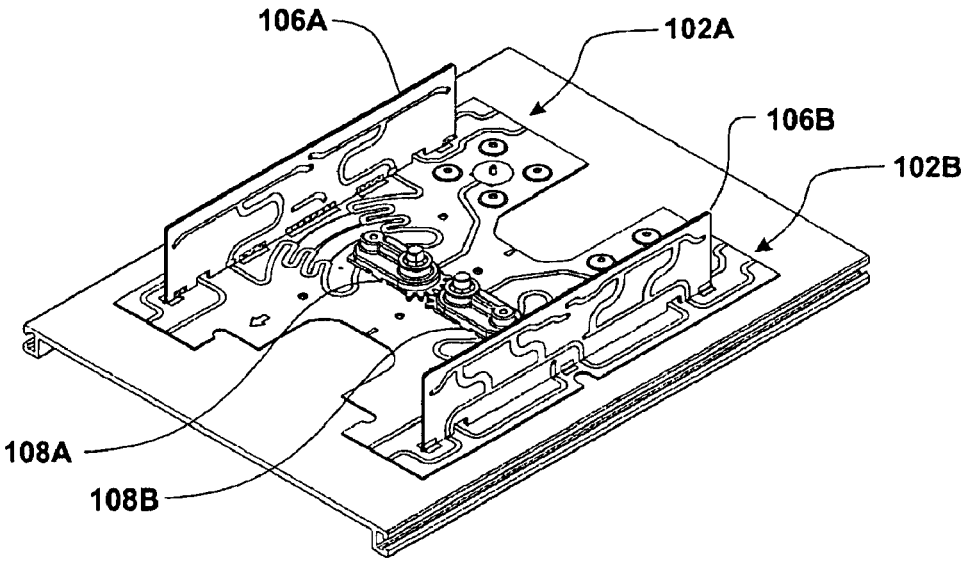
FIG. 10 is a perspective view of the top side of a beam steering circuit attached to a section of an antenna backplane.
Figure 11:
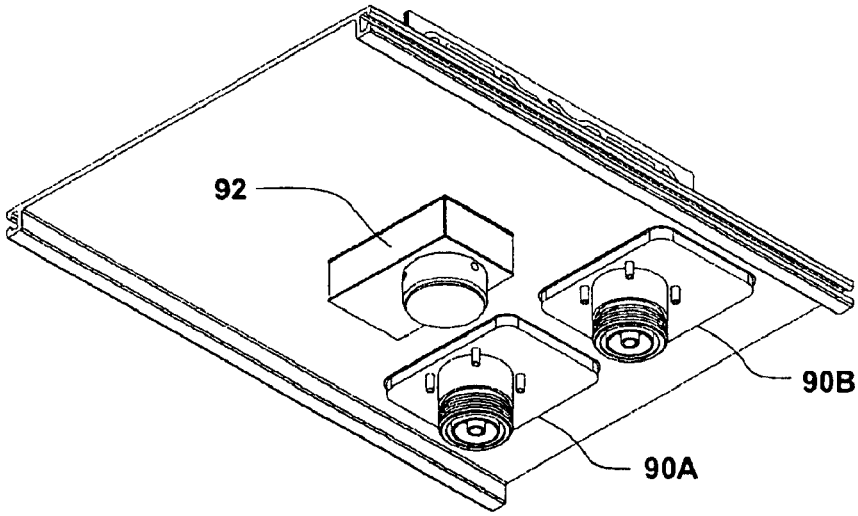
FIG. 11 is a perspective view of the bottom side of the beam steering circuit attached to a section of an antenna backplane.

FIG. 10 is a perspective view of the top side of the section of the antenna carrying the beam steering circuit, which includes the variable power dividers 102A–B and the beam forming modules 106A–B. This illustration provides a better view of the beam forming modules 106A–B and the wiper arms 108A–B. FIG. 11 is a perspective view of the bottom side of this same section of the antenna, which shows the cable connectors 90A–B and the control actuator 92.

Although this particular antenna does not include the variable tilt bias feature, it is configured to implement a downtilt bias of approximately 4.5 degrees with a tilt range from two to seven degrees. This is accomplished by varying the lengths of the transmission media trace legs to the antenna element of the sub-arrays using a center pivot method. Specifically, the trace length adjustments from the nominal in-phase length can be expressed in terms the wavelength in the guide $\lambda_g$ (in this particular embodiment about 4.52 inches [11.48 cm]) as follows:

First (top) sub-array trace length adjustment=108.337 degrees;

Second sub-array trace length adjustment=36.112 degrees;

Third sub-array trace length adjustment=−36.112 degrees; and

Fourth (bottom) sub-array trace length adjustment=−108.337 degrees.

In addition, this particular antenna is configured to implement phase blurring as described with reference to FIG. 3 as follows:

first (top) sub-array, first (top) element trace length adjustment=30 degrees first sub-array, second element trace length adjustment=0 degrees first sub-array, third element trace length adjustment=−30 degrees second sub-array, first element trace length adjustment=15 degrees second sub-array, second element trace length adjustment=0 degrees second sub-array, third element trace length adjustment=−15 degrees third sub-array, first element trace length adjustment=15 degrees third sub-array, second element trace length adjustment=0 degrees third sub-array, third element trace length adjustment=−15 degrees fourth (bottom) sub-array, first element trace length adjustment=30 degrees fourth sub-array, second element trace length adjustment=0.0 degrees fourth sub-array, third element trace length adjustment=−30 degrees An alternative tilt bias and element phase shift for this antenna is as follows:

First (top) sub-array trace length adjustment=101.25 degrees;

Second sub-array trace length adjustment=33.75 degrees;

Third sub-array trace length adjustment=−33.75 degrees; and

Fourth sub-array trace length adjustment=−101.25 degrees.

first (top) sub-array, first (top) element trace length adjustment=33.75 degrees first sub-array, second element trace length adjustment=0 degrees first sub-array, third (bottom) element trace length adjustment=−33.75 degrees second sub-array, first element trace length adjustment=16.875 degrees second sub-array, second element trace length adjustment=0 degrees second sub-array, third element trace length adjustment=−16.875 degrees third sub-array, first element trace length adjustment=16.875 degrees third sub-array, second element trace length adjustment=0 degrees third sub-array, third element trace length adjustment=−16.875 degrees fourth sub-array, first element trace length adjustment=33.75 degrees fourth sub-array, second element trace length adjustment=0 degrees fourth sub-array, third element trace length adjustment=−33.75 degrees For a sixteen element array with similar element spacing, a 3 degree tilt bias with phase blurring can be implemented is as follows:

First (top) sub-array trace length adjustment=122.062 degrees;

Second sub-array trace length adjustment=34.87 degrees;

Third sub-array trace length adjustment=−34.87 degrees; and

Fourth (bottom) sub-array trace length adjustment=−122.062 degrees.

first (top) sub-array, first (top) element trace length adjustment=67.5 degrees first sub-array, second element trace length adjustment=22.5 degrees first sub-array, third element trace length adjustment=−22.5 degrees first sub-array, fourth (bottom) element trace length adjustment=−67.5 degrees second sub-array, first element trace length adjustment=16.875 degrees second sub-array, second element trace length adjustment=5.635 degrees second sub-array, third element trace length adjustment=−5.625 degrees second sub-array, fourth element trace length adjustment=−16.875 degrees third sub-array, first element trace length adjustment=16.875 degrees third sub-array, second element trace length adjustment=5.625 degrees third sub-array, third element trace length adjustment=−5.625 degrees third sub-array, fourth element trace length adjustment=−16.875 degrees fourth (bottom) sub-array, first element trace length adjustment=67.5 degrees fourth sub-array, second element trace length adjustment=22.5 degrees fourth sub-array, third element trace length adjustment=−22.5 degrees fourth sub-array, fourth element trace length adjustment=−67.5 degrees In view of the foregoing, it will be appreciated that present invention provides significant improvements for implementing vertical electrical downtilt and sidelobe reduction for wireless base station antennas. It should be understood that the foregoing relates only to the exemplary embodiments of the present invention, and that numerous changes may be made therein without departing from the spirit and scope of the invention as defined by the following claims.

The invention claimed is:

1. An antenna system comprising:

an array of antenna elements defining a boresight direction;

a variable power divider using a single adjustable control element to divide an input voltage signal into a pair of complimentary amplitude voltage drive signals over a range of voltage amplitude division;

a beam forming network receiving the voltage drive signals and producing a plurality of beam driving signals wherein each beam driving signal comprises a component from each voltage drive signal;

a power distribution network delivering each beam driving signal to one or more associated antenna elements; and the beam driving signals driving the antenna elements to emit a beam exhibiting a directional tilt with respect to the boresight direction that varies within a range of tilt in response to changes of the voltage amplitude division within the range of voltage amplitude division; and a field adjustable tilt direction actuator for adjusting the voltage amplitude division and thereby adjusting the directional tilt of the beam.

2. The antenna system of claim 1, further comprising a remote controller for controlling the field adjustable tilt direction actuator.

3. The antenna system of claim 1, wherein the power distribution network implements coordinated phase shifting of the beam driving signals delivered to the antenna elements to cause a desired tilt bias of the range of tilt.

4. The antenna system of claim 3, further comprising a field adjustable tilt bias actuator for adjusting the tilt bias.

5. The antenna system of claim 4, further comprising a remote controller for controlling the field adjustable tilt bias actuator.

6. The antenna system of claim 1, wherein:

the antenna elements are organized into one or more inner sub-arrays located between outer sub-arrays; and each beam driving signal drives an associated antenna sub-array.

7. The antenna system of claim 6, wherein the number of antenna elements in the outer sub-arrays is greater than the number of antenna elements in the inner sub-arrays for the purpose of reducing sidelobe emission.

8. The antenna system of claim 7, wherein:

the number of outer sub-arrays is two;

the number of inner sub-arrays is two;

the number of antenna elements in each outer sub-array is four; and the number of antenna elements in each inner sub-array is two.

9. The antenna system of claim 7, wherein:

the number of outer sub-arrays is two;

the number of inner sub-arrays is two;

the number of antenna elements in each outer sub-array is five; and the number of antenna elements in each inner sub-array is three.

10. The antenna system of claim 6, wherein the power distribution network implements coordinated phase shifting of the beam driving signals delivered to the elements of one or more sub-arrays to cause a desired blurring of the phase matching of the signals emitted by antenna elements of the outer sub-arrays for the purpose of reducing sidelobe emission.

11. The antenna system of claim 10, wherein:

the number of outer sub-arrays is two;

the number of inner sub-arrays is two;

the number of antenna elements in each outer sub-array is four; and the number of antenna elements in each inner sub-array is four.

12. The antenna system of claim 10, wherein:

the number of outer sub-arrays is two;

the number of inner sub-arrays is two;

the number of antenna elements in each outer sub-array is three; and the number of antenna elements in each inner sub-array is three.

13. The antenna system of claim 6, comprising two outer sub-arrays and two inner sub-arrays, wherein the beam forming network is a two-by-four orthogonal beam forming network.

14. The antenna system of claim 6, comprising two outer sub-arrays and two inner sub-arrays, wherein the beam forming network is a four-by-four Butler matrix.

15. The antenna system of claim 6, wherein:

each antenna element is a dual-polarization antenna element, further comprising a similar a variable power divider, beam forming network, and power distribution network for each polarization; and wherein the power distribution network implements coordinated phase shifting of the beam driving signals delivered to the sub-arrays to cause a desired tilt bias of the range of tilt for each polarization.

16. The antenna system of claim 15, further comprising a field adjustable tilt bias actuator for adjusting the tilt bias for both polarities in a coordinated manner.

17. The antenna system of claim 1, wherein each antenna element is a dual-polarization antenna element, further comprising a similar a variable power divider, beam forming network, and power distribution network for each polarization.

18. The antenna system of claim 17, wherein the field adjustable tilt direction actuators are mechanically linked to each other to adjust the beam tilt for both polarities in a coordinated manner.

19. The antenna system of claim 1, further comprising:

a substantially flat main panel defining a longitudinal axis substantially perpendicular to the boresight direction;

the main panel supports the variable power divider, the power distribution network, and the array of antenna elements in a spacing configuration having a substantially vertical distribution;

the array divided into one or more inner sub-arrays located vertically between outer sub-arrays; and wherein the beam forming network is configured as a double-sided, edge-connected module mounted to the main panel.

20. An antenna system comprising:

an array of antenna elements defining a boresight direction;

a variable power divider receiving and dividing an input voltage signal into a pair of matched phase, complimentary amplitude voltage drive signals exhibiting constant phase delay through the variable power divider over a range of voltage amplitude division;

a beam forming network receiving the voltage drive signals and producing a plurality of beam driving signals wherein each beam driving signal comprises a component from each voltage drive signal;

a power distribution network delivering each beam driving signal to an associated sub-array; and the beam driving signals driving the antenna elements to emit a beam exhibiting a directional tilt with respect to the boresight direction that varies within a range of tilt in response to changes of the voltage amplitude division within the range of voltage amplitude division.

21. The antenna system of claim 20, further comprising:

a substantially flat main panel defining a longitudinal axis substantially perpendicular to the boresight direction;

the main panel supports the variable power divider, the power distribution network, and the array of antenna elements in a spacing configuration having a substantially vertical distribution;

the array divided into one or more inner sub-arrays located vertically between outer sub-arrays; and wherein the beam forming network is configured as a double-sided, edge-connected module mounted to the main panel.

22. The antenna system of claim 21, wherein the power distribution network implements coordinated phase shifting of the beam driving signals delivered to the sub-arrays to cause a desired tilt bias of the range of tilt.

23. The antenna system of claim 21, further comprising a field adjustable tilt bias actuator for adjusting the tilt bias.

24. The antenna system of claim 21, wherein the number of antenna elements in the outer sub-arrays is greater than the number of antenna elements in the inner sub-arrays for the purpose of reducing sidelobe emission.

25. The antenna system of claim 21, wherein the power distribution network implements coordinated phase shifting of the beam driving signals delivered to the elements of one or more sub-arrays to cause a desired blurring of the phase matching of the signals emitted by antenna elements of the outer sub-arrays for the purpose of reducing sidelobe emission.

26. An antenna system comprising:

an array of antenna elements defining a boresight direction and one or more inner sub-arrays located between outer sub-arrays;

a variable power divider producing complimentary amplitude voltage drive signals over a range of voltage amplitude division;

a beam forming network receiving the voltage drive signals and producing a plurality of beam driving signals;

a power distribution network delivering each beam driving signal to one or more associated antenna elements;

the beam driving signals driving the antenna elements to emit a beam exhibiting a directional tilt with respect to the boresight direction that varies within a range of tilt in response to changes of the voltage amplitude division within the range of voltage amplitude division; and wherein the power distribution network implements coordinated phase shifting of the beam driving signals delivered to the sub-arrays to cause a desired tilt bias of the range of tilt.

27. The antenna system of claim 26, further comprising:

a substantially flat main panel defining a longitudinal axis substantially perpendicular to the boresight direction;

the main panel supports the variable power divider, the power distribution network, and the array of antenna elements in a spacing configuration having a substantially vertical distribution;

the array divided into one or more inner sub-arrays located vertically between outer sub-arrays; and wherein the beam forming network is configured as a double-sided, edge-connected module mounted to the main panel.

28. An antenna system comprising:

an array of antenna elements defining a boresight direction and one or more inner sub-arrays located between outer sub-arrays;

a variable power divider producing complimentary amplitude voltage drive signals over a range of voltage amplitude division;

a beam forming network receiving the voltage drive signals and producing a plurality of beam driving signals;

a power distribution network delivering each beam driving signal to one or more associated antenna elements;

the beam driving signals driving the antenna elements to emit a beam exhibiting a directional tilt with respect to the boresight direction that varies within a range of tilt in response to changes of the voltage amplitude division within the range of voltage amplitude division;

wherein the number of antenna elements in the outer sub-arrays is greater than the number of antenna elements in the inner sub-arrays for the purpose of reducing sidelobe emission.

29. The antenna system of claim 28, further comprising:

a substantially flat main panel defining a longitudinal axis substantially perpendicular to the boresight direction;

the main panel supports the variable power divider, the power distribution network, and the array of antenna elements in a spacing configuration having a substantially vertical distribution;

the array divided into one or more inner sub-arrays located vertically between outer sub-arrays; and wherein the beam forming network is configured as a double-sided, edge-connected module mounted to the main panel.

30. A an antenna system comprising:

an array of antenna elements defining a boresight direction and one or more inner sub-arrays located between outer sub-arrays;

a variable power divider producing complimentary amplitude voltage drive signals over a range of voltage amplitude division;

a beam forming network receiving the voltage drive signals and producing a plurality of beam driving signals;

a power distribution network delivering each beam driving signal to one or more associated antenna elements; and the beam driving signals driving the antenna elements to emit a beam exhibiting a directional tilt with respect to the boresight direction that varies within a range of tilt in response to changes of the voltage amplitude division within the range of voltage amplitude division; and a field adjustable tilt direction actuator for the adjusting voltage amplitude division and thereby adjusting the directional tilt of the beam; and wherein the power distribution network implements coordinated phase shifting of the beam driving signals delivered to the elements of one or more sub-arrays to cause a desired blurring of the phase matching of the signals emitted by antenna elements of the outer sub-arrays for the purpose of reducing sidelobe emission.

31. The antenna system of claim 30, further comprising:

a substantially flat main panel defining a longitudinal axis substantially perpendicular to the boresight direction;

the main panel supports the variable power divider, the power distribution network, and the array of antenna elements in a spacing configuration having a substantially vertical distribution;

the array divided into one or more inner sub-arrays located vertically between outer sub-arrays; and wherein the beam forming network is configured as a double-sided, edge-connected module mounted to the main panel.

* * * * *